US006484732B1

(12) United States Patent
Simister

(10) Patent No.: US 6,484,732 B1
(45) Date of Patent: Nov. 26, 2002

(54) CARRYING SYSTEM FOR DENTAL HYGIENE SUPPLIES

(76) Inventor: Nigel Simister, 61 E. 57th St., Brooklyn, NY (US) 11203

( * ) Notice: Subject to any disclaimer, the term of this patent is extended or adjusted under 35 U.S.C. 154(b) by 0 days.

(21) Appl. No.: 09/815,712

(22) Filed: Mar. 23, 2001

(51) Int. Cl.[7] ..... A45D 44/18
(52) U.S. Cl. ..... 132/309; 132/314; 206/581
(58) Field of Search ..... 132/309, 308, 132/314, 315, 310, 295; 206/581, 63.5, 539, 369, 368, 370

(56) References Cited

U.S. PATENT DOCUMENTS

| | | | | | |
|---|---|---|---|---|---|
| 941,608 | A | * | 11/1909 | Benson | 206/231 |
| 1,465,627 | A | * | 8/1923 | Fisher et al. | 312/31 |
| 1,633,834 | A | * | 6/1927 | Vaitulis | 206/362.1 |
| 4,163,496 | A | * | 8/1979 | Dogliotti | 206/538 |
| 4,328,892 | A | | 5/1982 | Heitlinger | 206/229 |
| 5,095,924 | A | | 3/1992 | Stanfield | 132/315 |
| 5,348,028 | A | | 9/1994 | Gustavel | 132/309 |
| 5,423,427 | A | | 6/1995 | Brown | 206/581 |
| 5,701,921 | A | | 12/1997 | Father et al. | 132/309 |
| 5,762,199 | A | * | 6/1998 | Aguilera | 206/533 |
| D398,150 | S | | 9/1998 | Vonarburg | D3/302 |
| 6,220,253 | B1 | * | 4/2001 | Wright | 132/310 |

* cited by examiner

*Primary Examiner*—Nicholas D. Lucchesi
*Assistant Examiner*—Melba Bumgarner

(57) ABSTRACT

A carrying system for dental hygiene supplies for promoting dental hygiene of a user by enabling a user to practice dental hygiene when traveling away from home. The carrying system for dental hygiene supplies includes a container that has a bottom wall and a peripheral wall extending upwardly from the bottom wall with an edge of the peripheral wall defining an opening extending into an interior of the container. A plurality of intermediate walls is provided for dividing the interior of the container into a plurality of compartments with each of the intermediate walls extending upwardly away from the bottom wall toward the opening. In one embodiment of the present invention, each of the compartments is adapted for receiving the toothbrush, tube of toothpaste, mouthwash and container of dental floss.

20 Claims, 2 Drawing Sheets

CARRYING SYSTEM FOR DENTAL HYGIENE SUPPLIES

BACKGROUND OF THE INVENTION

1. Field of the Invention

The present invention relates to carrying devices and more particularly pertains to a new carrying system for dental hygiene supplies for promoting dental hygiene of a user by enabling a user to practice dental hygiene when traveling away from home with supplies carried in a single compact container having convenient access to the supplies.

2. Description of the Prior Art

The use of carrying devices is known in the prior art. More specifically, carrying devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,328,892; 5,348,028; 5,423,427; 5,701,921; 5,095,924; and Des. 398,150.

While these devices fulfill their respective, particular objectives and requirements, the aforementioned patents do not disclose a new carrying system for dental hygiene supplies. The inventive device includes a container that has a bottom wall and a peripheral wall extending upwardly from the bottom wall with an edge of the peripheral wall defining an opening extending into an interior of the container. A plurality of intermediate walls is provided for dividing the interior of the container into a plurality of compartments with each of the intermediate walls extending upwardly away from the bottom wall toward the opening. In one embodiment of the present invention, the toothbrush, tube of toothpaste, mouthwash and container of dental floss are positionable in a respective compartment.

In these respects, the carrying system for dental hygiene supplies according to the present invention substantially departs from the conventional concepts and designs of the prior art, and in so doing provides an apparatus primarily developed for the purpose of promoting dental hygiene of a user by enabling a user to practice dental hygiene when traveling away from home.

SUMMARY OF THE INVENTION

In view of the foregoing disadvantages inherent in the known types of carrying devices now present in the prior art, the present invention provides a new carrying system for dental hygiene supplies construction wherein the same can be utilized for promoting dental hygiene of a user by enabling a user to practice dental hygiene when traveling away from home.

The general purpose of the present invention, which will be described subsequently in greater detail, is to provide a new carrying system for dental hygiene supplies apparatus and method which has many of the advantages of the carrying devices mentioned heretofore and many novel features that result in a new carrying system for dental hygiene supplies which is not anticipated, rendered obvious, suggested, or even implied by any of the prior art carrying devices, either alone or in any combination thereof.

To attain this, the present invention generally comprises a container that has a bottom wall and a peripheral wall extending upwardly from the bottom wall with an edge of the peripheral wall defining an opening extending into an interior of the container. A plurality of intermediate walls is provided for dividing the interior of the container into a plurality of compartments with each of the intermediate walls extending upwardly away from the bottom wall toward the opening. In one embodiment of the present invention, the toothbrush, tube of toothpaste, mouthwash and container of dental floss are positionable in a respective compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carrying system for dental hygiene supplies apparatus and method which has many of the advantages of the carrying devices mentioned heretofore and many novel features that result in a new carrying system for dental hygiene supplies which is not anticipated, rendered obvious, suggested, or even implied by any of the prior art carrying devices, either alone or in any combination thereof.

It is another object of the present invention to provide a new carrying system for dental hygiene supplies which may be easily and efficiently manufactured and marketed.

It is a further object of the present invention to provide a new carrying system for dental hygiene supplies which is of a durable and reliable construction.

An even further object of the present invention is to provide a new carrying system for dental hygiene supplies which is susceptible of a low cost of manufacture with regard to both materials and labor, and which accordingly is then susceptible of low prices of sale to the consuming public, thereby making such carrying system for dental hygiene supplies economically available to the buying public.

Still yet another object of the present invention is to provide a new carrying system for dental hygiene supplies which provides in the apparatuses and methods of the prior art some of the advantages thereof, while simultaneously overcoming some of the disadvantages normally associated therewith.

Still another object of the present invention is to provide a new carrying system for dental hygiene supplies for promoting dental hygiene of a user by enabling a user to practice dental hygiene when traveling away from home.

Yet another object of the present invention is to provide a new carrying system for dental hygiene supplies which includes a container that has a bottom wall and a peripheral wall extending upwardly from the bottom wall with an edge of the peripheral wall defining an opening extending into an interior of the container. A plurality of intermediate walls is provided for dividing the interior of the container into a plurality of compartments with each of the intermediate walls extending upwardly away from the bottom wall toward the opening. In one embodiment of the present invention, the toothbrush, tube of toothpaste, mouthwash and container of dental floss.are positionable in a respective compartment.

Still yet another object of the present invention is to provide a new carrying system for dental hygiene supplies that provides a user a means of organizing all of their dental hygiene supplies while traveling.

Even still another object of the present invention is to provide a new carrying system for dental hygiene supplies that encourages users to practice good dental hygiene. Since the present invention is compact and easily transportable, a user may brush or floss their teeth any time they feel the need to brush or floss, and the compactness permits carrying the device in the pocket or handbag of the user. Additionally, good dental hygiene has the potential of preventing a user from having to endure pain or high dental bills due to poor dental hygiene.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
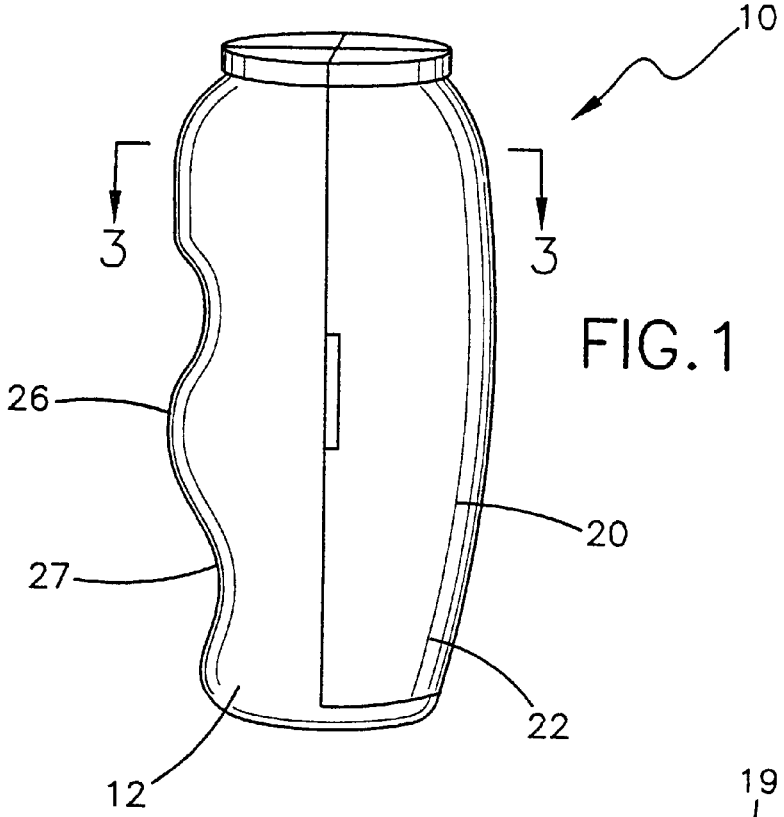
FIG. 1 is a schematic perspective view of a new carrying system for dental hygiene supplies according to the present invention.

With reference now to the drawings, and in particular to FIGS. 1 through 4 thereof, a new carrying system for dental hygiene supplies embodying the principles and concepts of the present invention and generally designated by the reference numeral 10 will be described.

As best illustrated in FIGS. 1 through 4, the carrying system 10 for dental hygiene supplies generally comprises a container 12 that includes a bottom wall 14 and a peripheral wall 16 extending upwardly from the bottom wall 14. An edge 17 of the peripheral wall 16 defines an opening 18 extending into an interior 19 of the container 12. The peripheral wall 16 may include a door portion 20 formed therein for accessing the interior 19 of the container 12. The door portion 20 includes an inner 21 surface and an outer surface 22. The inner surface 21 preferably has a generally concave shape similar to the shape of the peripheral wall. The container 12 may have a length measuring approximately five inches and a width measuring approximately three inches. However, the container 12 may be manufacture in a variety of dimensions.

Figure 2:
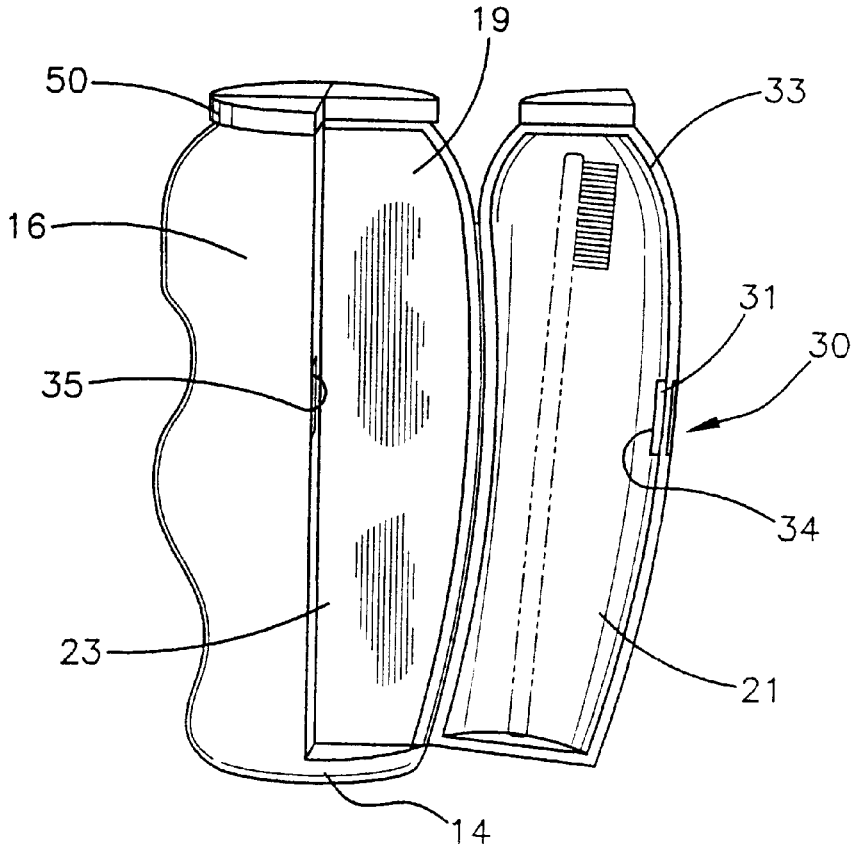
FIG. 2 is a schematic perspective view of the present invention showing a peripheral wall of a container having a door portion formed therein.

The door portion 20 is pivotally movable between an open condition and a closed condition. In one embodiment of the present invention, as particularly illustrated in FIG. 2, the open condition is characterized by the formation of an opening 23 extending through the peripheral wall and into the interior 19 of the container 12. The closed condition is characterized by the opening 23 being blocked by the door portion 20. A portion of the outer surface of the peripheral wall 16 may include a pair of spaced ridges 26 and a pair of spaced grooves 27 extending therein. The pair of spaced ridges 26 and grooves 27 are preferably positioned generally opposite the door portion 20. The container 20 may comprise a substantially rigid material, such as plastic. Optionally, the door portion 20 may be pivotally moved to the remainder of the peripheral wall by a living hinge As illustrated in FIG. 2, a fastening member 30 maybe provided for releasably securing the door portion 20 in the closed condition. The fastening member 30 may comprise a plate 31 that is mounted in an edge 33 of door portion 20. An end 34 of the plate 31 is removably insertable in an aperture 35 extending into the peripheral wall 16 of the container 12.

Figure 3:
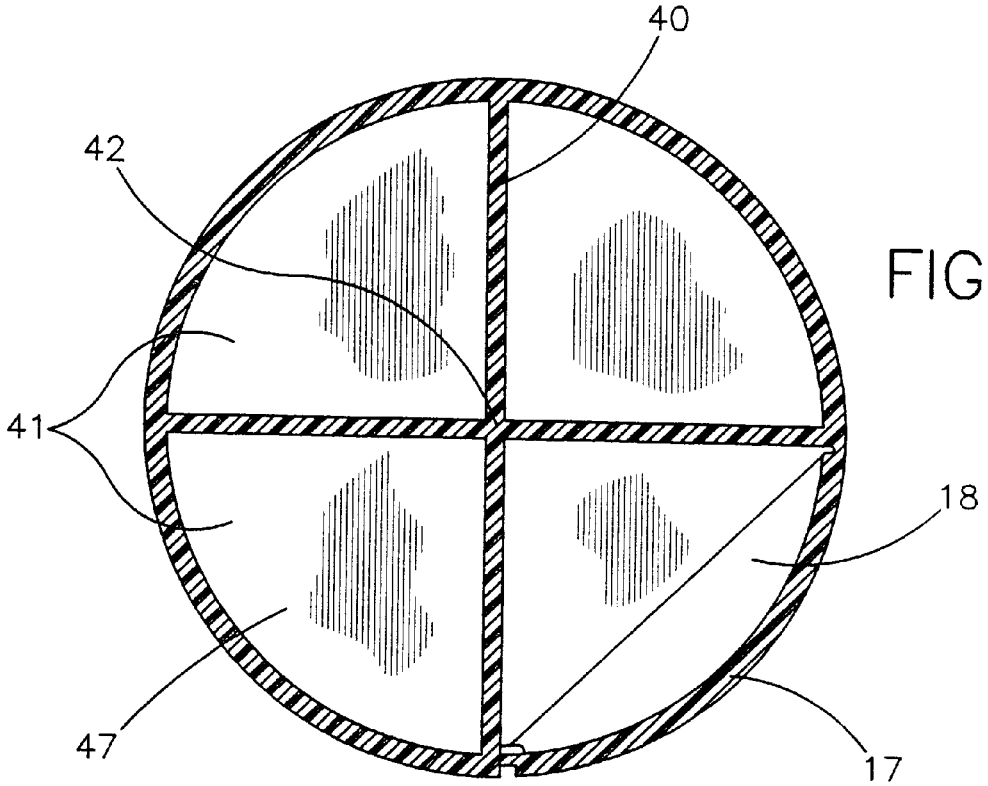
FIG. 3 is a schematic top view of the present invention showing a plurality of intermediate walls dividing an interior of the container into a plurality of compartments.

As illustrated in FIG. 3, a plurality of intermediate walls 40 is provided for dividing the interior 19 of the container 12 into a plurality of compartments 41. Each of the intermediate walls 40 extends upwardly away from the bottom wall 14 toward the opening 18 of the container 12. Each of the intermediate walls 40 is preferably joined together such that a juncture 42 of the intermediate walls 40 extends along a longitudinal axis of the container 12. In one embodiment of the present invention, each of the compartments 41 is adapted for receiving the toothbrush, tube of toothpaste, mouthwash and container of dental floss.

Figure 4:
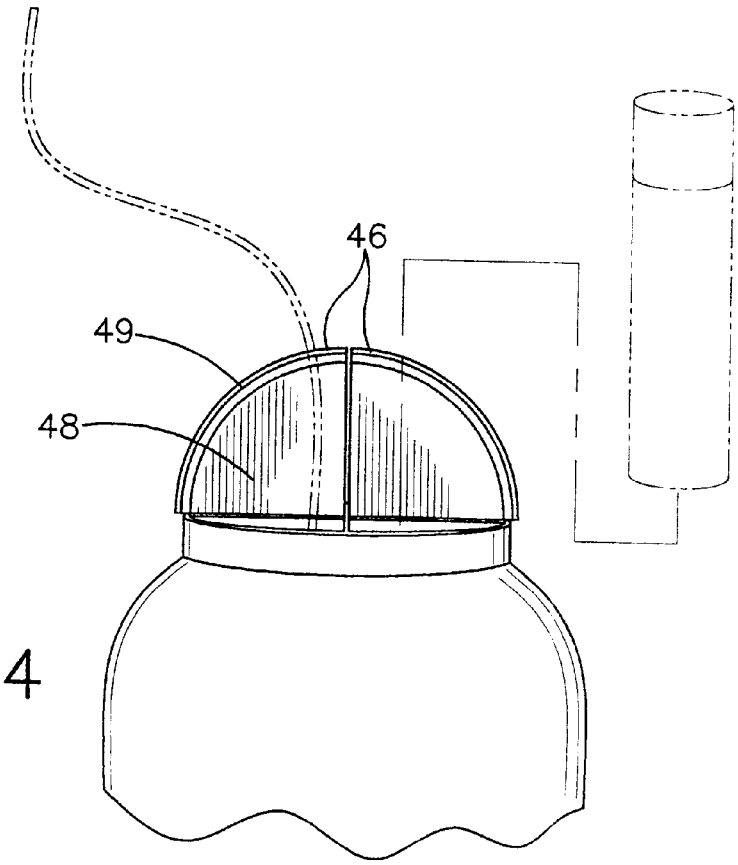
FIG. 4 is a schematic perspective view of the present invention showing a plurality of covers attached to the container and covering an opening extending into the interior of the container.

As illustrated in FIG. 4, a plurality of covers 46 maybe provided for covering the opening 18 of the container 12. Each of the covers 46 is preferably pivotally coupled to a respective intermediate wall 40 such that each of the compartments 41 are covered by one of the covers 46. Each of the covers 46 includes an upper side 47, a lower side 48 and an outer edge 49. The outer edge 49 includes a lip 50 extending downwardly from the outer edge 49. The lip 50 selectively engages a portion of the edge 17 of the container 12. The outer edge 49 of each of the covers 46 preferably includes a generally arcuate shape similar to the peripheral wall 16 of the container 12.

In use, the dental hygiene supplies are stored in one of the compartments 41. Each of the covers 46 and the door portion 20 secure the dental hygiene supplies in the container 12 during transportions.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrying system for dental hygiene supplies such as, a toothbrush, a tube of toothpaste, a tube of mouth wash and a container of dental floss, said system comprising:

a container having a bottom wall and a peripheral wall extending upwardly from said bottom wall, an edge of said peripheral wall defining an opening extending into an interior of said container;

a plurality of intermediate walls for dividing said interior of said container into a plurality of compartments, each of said intermediate walls extending upwardly away from said bottom wall toward said opening, wherein each of said compartments is adapted for receiving the toothbrush, tube of toothpaste, mouthwash and container of dental floss; and said peripheral wall having a door portion formed therein for accessing one of said compartments in said interior of said container, said door portion extending substantially a full length of said container;

wherein a portion of an outer surface of said peripheral wall of said container has a series of alternating ribs and grooves forming an undulating surface for gripping by fingers of a user.

2. The carrying system of claim 1, wherein said door portion is pivotally movable between an open condition and a closed condition.

3. The carrying system of claim 2, wherein said open condition of said door portion is characterized by an opening extending through said peripheral wall and into said interior of said container, wherein said closed condition is characterized by said opening in said peripheral wall being blocked by said door portion.

4. The carrying system of claim 2, additionally including a fastening member for releasably securing said door portion in said closed condition, said fastening member comprising a plate being mounted in an edge of said door portion, an end of said plate being removably insertable in an aperture extending into said peripheral wall of said container.

5. The carrying system of claim 1, wherein said door portion has an inner surface and an outer surface, said inner surface having a generally concave shape.

6. The carrying system of claim 1, wherein each of said intermediate walls is joined together such that a juncture of said intermediate walls extends along a longitudinal axis of said container.

7. The carrying system of claim 1, wherein one of said plurality of compartments is accessible through said opening in said container.

8. The carrying system of claim 1, wherein said door portion occupies approximately one-quarter of said peripheral wall of said container.

9. The carrying system of claim 1, additionally including a plurality of covers for covering said opening of said container, each of said covers being pivotally coupled to a respective intermediate wall such that each of said compartments are covered by one of said covers.

10. The carrying system of claim 9, wherein each of said covers has an upper side, a lower side and an outer edge, said outer edge having a lip extending downwardly from said outer edge, said lip selectively engaging a portion of said edge of said container.

11. The carrying system of claim 10, wherein said outer edge of each of said covers has a generally arcuate shape.

12. A carrying system for dental hygiene supplies such as, a toothbrush, a tube of toothpaste, a tube of mouth wash and a container of dental floss, said system comprising:

a container having a bottom wall and a peripheral wall extending upwardly from said bottom wall, an edge of said peripheral wall defining an opening extending into an interior of said container;

a plurality of intermediate walls for dividing said interior of said container into a plurality of compartments, each of said intermediate walls extending upwardly away from said bottom wall toward said opening, wherein each of said compartments is adapted for receiving the toothbrush, tube of toothpaste, mouthwash and container of dental floss;

said peripheral wall having a door portion formed therein for accessing one of said compartments in said interior of said container, said door portion extending substantially a full length of said container; and said peripheral wall having a door portion formed therein for accessing one of said compartments in said interior of said container, said door portion extending substantially a full length of said container; and a plurality of covers for covering said opening of said container, each of said covers being pivotally coupled to a respective intermediate wall such that each of said compartments is covered by one of said covers.

13. The carrying system of claim 12, wherein each of said covers has an upper side, a lower side and an outer edge, said outer edge having a lip extending downwardly from said outer edge, said lip selectively engaging a portion of said edge of said peripheral wall.

14. The carrying system of claim 13, wherein said outer edge of each of said covers has a generally arcuate shape.

15. The carrying system of claim 12, wherein said door portion is pivotally movable between an open condition and a closed condition.

16. The carrying system of claim 15, wherein said open condition of said door portion is characterized by an opening extending through said peripheral wall and into said interior of said container, wherein said closed condition is characterized by said opening in said peripheral wall being blocked by said door portion.

17. The carrying system of claim 15, additionally including a fastening member for releasably securing said door portion in said closed condition, said fastening member comprising a plate being mounted in an edge of said door portion, an end of said plate being removably insertable in an aperture extending into said peripheral wall of said container.

18. The carrying system of claim 12, wherein said door portion has an inner surface and an outer surface, said inner surface having a generally concave shape.

19. The carrying system of claim 12, wherein each of said intermediate walls is joined together such that a juncture of said intermediate walls extends along a longitudinal axis of said container.

20. A carrying system for dental hygiene supplies such as, a toothbrush, a tube of toothpaste, a tube of mouth wash and a container of dental floss, said system comprising:

a container having a bottom wall and a peripheral wall extending upwardly from said bottom wall, an edge of said peripheral wall defining an opening extending into an interior of said container, said peripheral wall having a door portion formed therein for accessing said interior of said container, said door portion extending substantially a full length of said container, wherein said door portion occupies approximately one-quarter of said peripheral wall of said container, said door portion having an inner surface and an outer surface, said inner surface having a generally concave shape, said door portion being pivotally movable between an open condition and a closed condition, wherein said open condition being characterized by the formation of an opening extending through said peripheral wall and into said interior of said container, wherein said closed condition being characterized by said opening through said peripheral wall being blocked by said door portion, a portion of an outer surface of said peripheral wall of said container having a series of alternating ribs and grooves forming an undulating surface for gripping by fingers of a user, said container comprising a substantially rigid material;

a fastening member for releasably securing said door portion in a closed condition with respect to said peripheral wall, said fastening member comprising a plate being mounted in an edge of door portion, an end of said plate being removably insertable in an aperture extending into said peripheral wall of said container;

a plurality of intermediate walls for dividing said interior of said container into a plurality of compartments, each of said intermediate walls extending upwardly away from said bottom wall toward said opening, each of said intermediate walls being joined together such that a juncture of said intermediate walls extends along a longitudinal axis of said container, wherein one of said plurality of compartments is accessible through said opening in said of said container, wherein each of said compartments being adapted for selectively receiving the toothbrush, tube of toothpaste, mouthwash and container of dental floss; and a plurality of covers for covering said opening of said container, each of said covers being pivotally coupled to a respective intermediate wall such that each of said compartments are covered by one of said covers, each of said covers having an upper side, a lower side and an outer edge, said outer edge having a lip extending downwardly from said outer edge, said lip selectively engaging a portion of said edge of said container, said outer edge of each of said covers having a generally arcuate shape.

* * * * *